United States Patent [19]

Eda et al.

[11] Patent Number: 5,075,645

[45] Date of Patent: Dec. 24, 1991

[54] MATCHING CIRCUIT FOR HIGH FREQUENCY TRANSISTOR

[75] Inventors: Kazuo Eda, Nara; Tetsuji Miwa, Osaka; Yutaka Taguchi, Kadoma, all of Japan

[73] Assignee: Matsushita Electric Industrial Co., Ltd., Osaka, Japan

[21] Appl. No.: 564,761

[22] Filed: Aug. 3, 1990

[30] Foreign Application Priority Data

Aug. 4, 1989 [JP] Japan ..... 1-203292
Aug. 4, 1989 [JP] Japan ..... 1-203293

[51] Int. Cl.[5] ..... H01P 5/08

[52] U.S. Cl. ..... 333/34; 333/161; 333/247

[58] Field of Search ..... 333/33, 34, 246, 247, 333/161

[56] References Cited

U.S. PATENT DOCUMENTS 3,419,813 12/1968 Kamnitsis ..... 333/34 X
4,272,731 6/1981 Day et al. ..... 333/33 X

FOREIGN PATENT DOCUMENTS 62-269402 11/1987 Japan .
64-50602 2/1989 Japan .
64-74812 3/1989 Japan .

OTHER PUBLICATIONS

"Microwave Integrated-Circuit Technology-A Survey", IEEE Journal of Solid-State Circuits, vol. SC-5, No. 6, Dec. 1970, pp. 292-303.

"Broad-Band Internal Matching of Microwave Power GaAs MESFET's", IEEE Transactions of Microwave Theory and Techniques, vol. MTT-27, No. 1, Jan. 1979, pp. 3-8.

*Primary Examiner*—Paul Gensler
*Attorney, Agent, or Firm*—Wenderoth, Lind & Ponack

[57] ABSTRACT

In a matching circuit for a high-frequency transistor, using a microstrip line for the main line and having a high-frequency transistor side main line shaped in a taper form, a thin-film capacitor and a grounding circuit are disposed between the taper part and the ground. The length of the parts of the thin-film capacitor is different in the signal traveling directions or the shape of the grounding circuit is different so that the impedance is matched at the output position of the thin-film capacitor part, while the spatial phase difference of high-frequency signals can be compensated at the same time.

8 Claims, 4 Drawing Sheets

MATCHING CIRCUIT FOR HIGH FREQUENCY TRANSISTOR

BACKGROUND OF THE INVENTION

1. Field of the Invention

The present invention relates to a matching circuit for the input and output of a transistor used in high-frequency, high-power amplifier, and more particularly, to a matching circuit for a high-frequency, high-power transistor which is capable of eliminating a reduction of in the amplification efficiency due to a phase difference caused by the spatial dimensions of the transistor, and which is capable of matching the impedance as well.

2. Description of the Prior Art

In the field of electric communications, the signal frequency is becoming higher, and especially in the field of satellite communications, the frequency is exceeding 10 GHz. Along with this trend, the devices and apparatuses used at such frequencies are required to be smaller in size, and accordingly there is an increasing need for inexpensive integrated circuits having favorable characteristics that can be used in the microwave band.

The input and output impedances of high frequency transistors employed in such integrated circuits do not generally coincide with the main transmission line characteristic impedance (50 ohms). In the main transmission line, lines known as microstrip lines are widely employed. In order to amplify an electric signal efficiently, it is desired that the transistor input and output impedances and the impedances of the input and output main line microstrip lines be matched as closely as possible, and that the reflection at the matching point be as small as possible. In particular, the input and output impedances of the high frequency and high-power transistor is much lower than 50 ohms, and usually a low impedance element is inserted parallel to the input and output main line microstrip lines in order to match the impedance. The impedance Zos of an open microstrip line (an open stub) is expressed as follows:

$$Zos = -j \cdot \cot \beta L \quad (1)$$

where $\beta = 2\pi/\lambda$; $\lambda$ is the wavelength on the microstrip line at the frequency to be matched; and L = Length of the microstrip line.

Therefore, Zos becomes smaller as $\beta L$ approaches $\pi/2$, that is, as L approaches $\lambda/4$, and by selecting a proper value, matching with the transistor is achieved.

A typical structure of a conventional high-frequency amplifier according to this method is shown in FIG. 7.

In FIG. 7, numeral 101 denotes a field effect transistor (FET), 102 denotes an input matching circuit substrate, 103 denotes an output matching circuit substrate, 104 is a main line composed of a microstrip line connected to an input terminal, 105 denotes a main line composed of a microstrip line connected to an output terminal, and 106 and 107 denotes so-called taper parts each having a gradually widening electrode width and disposed at the transistor side of the main line. Numerals 110 and 111 denote wires for connecting the transistor and the taper parts, 701 and 702 denote insular electrodes (pads) for the adjustment of input and output impedance matching, respectively, and 703 an 704 denote wires for connecting the taper parts and the adjusting pads. In this construction, the adjustment of the input matching circuit and output matching circuit is achieved by connecting the adjusting pads to the wires.

A typical example of such an adjusting method is disclosed in the Japanese Patent Publication 57-23441.

As an improved version thereof, a method of employing chip capacitors for matching is known. For example, a typical example is reported in "Broad-Band Internal Matching of Microwave Power GaAs MESFET's," K. Honjo, Y. Takayama, and A. Higashisaka, IEEE Transactions on Microwave Theory and Techniques, Vol. MTT-27, No. 1, 1979, pp. 3–8.

A typical structure of this method is shown in FIG. 8. In FIG. 8, numerals 101 to 107 denote the same parts as in FIG. 7. Numerals 801 and 802 denote chip capacitors for input and output impedance matching, respectively, and both lower electrodes are connected on a grounded base, and the upper electrodes are connected to the main line microstrip line taper parts of input and output matching adjusting circuit substrates and to the transistor by means of wires 803, 804, 805, 806. In this structure, the input and output matching is achieved by the chip capacitor and the inductance of the wire connecting it.

Further, a method of matching by using a thin-film capacitor instead of the chip capacitor is disclosed in "Microwave Integrated-Circuit Technology-A Survey," M. Caulton, and H. Sobol, IEEE Journal of Solid-State Circuits, Vol. SC-5, No. 6, 1970, pp. 292–303.

In these conventional methods, however, matching of only the impedance is taken into consideration, and no consideration is given to the phase difference of electric signals in the taper parts. Moreover, such methods are insufficient to realize matching circuits for a high-frequency, high-power FET having a gate width comparable to the signal wavelength, in particular. At 14 GHz, for example, the length corresponding to $\frac{1}{4}$ wavelength on the alumina substrate or GaAs substrate is about 2 mm. On the other hand, the gate width of the GaAs FET for obtaining an output of 3 watts is about 4 mm. Therefore, there is a considerable phase difference between the electric signal passing the central part of the taper part and the electric signal passing the end part. When a phase difference occurs in the input signal, a phase difference also takes place in the signal after being amplified by the FET, and as a result the synthesized output signal is attenuated, and the amplification efficiency is lowered. At the taper part in the output area, a spatial phase difference also occurs, and the performance is further lowered.

In the matching method by the open stub shown in the first prior art, it is considerably difficult to match the high-frequency, high-power FET which has low input, output impedances, and usually the composition of the second prior art is employed.

In the case of the second prior art, however, it is necessary to connect a large chip capacitor separately. Accordingly, it is easier to match the impedance than in the first prior art, but in the manufacturing procedure the process for mounting the chip is increased, and a chip mounting part is additionally required, which makes it hard to reduce the size and integrate to a high degree. As a result the manufacturing cost becomes higher.

By modifying the shape of the taper parts to reduce the spatial phase difference, other methods are proposed for example in the Japanese Patent Publications 64-50602, 64-74812, but these are not intended to satisfy the impedance matching simultaneously.

Incidentally, as a method of matching while eliminating the spatial phase difference, so-called power distributors and power synthesizers using ¼ wavelength impedance converters are known, and they are generally used in the power amplifiers of several watts or more. It is, however, difficult to reduce the size thereof because an impedance converter in the length of at least ¼ wavelength is required.

SUMMARY OF THE INVENTION

It is hence a primary object of the invention to present a matching circuit for a high-frequency, high-power transistor which is capable of matching the impedance of the high-frequency, high-power transistor, having a low impedance and large size, compensating the spatial phase difference thereof simultaneously, and requiring a small number of mounting processes, which is capable of realizing a size reduction and high degree of integration, and lower manufacturing costs.

To achieve the above object, the invention presents a matching circuit having a main line composed of a micro-strip line, a high-frequency transistor side main line shaped in a taper form, and a thin-film capacitor part made of a dielectric having different dielectric constant than that of a substrate and disposed between the tapered part and the ground, wherein the length of the thin-film capacitor part in a traveling direction of a high-frequency signal is continuously different in the tapered part so that a phase difference of the high-frequency signal is compensated at an output position of the thin-film capacitor part.

The invention also presents a matching circuit having a main line composed of a microstrip line, a high-frequency transistor side main line shaped in a taper form, and a series circuit of a thin-film capacitor and a closed microstrip line between the taper part and the ground, wherein the length of the closed microstrip line to the ground is different at the part of the thin-film capacitor so that a phase difference of the high-frequency signal is compensated at an output position of the thin-film capacitor part.

In the constitution described herein, the impedance of the high-frequency, high-power transistor having a low impedance is matched, while the phase difference of a signal caused by the spatial size of the transistor can be eliminated at the same time. Moreover the number of mounting processes is small, and smaller size and higher integration are possible, so that a matching circuit for a high-frequency, high-power transistor can be realized at a low manufacturing cost.

DESCRIPTION OF THE PREFERRED EMBODIMENTS

Figure 1:
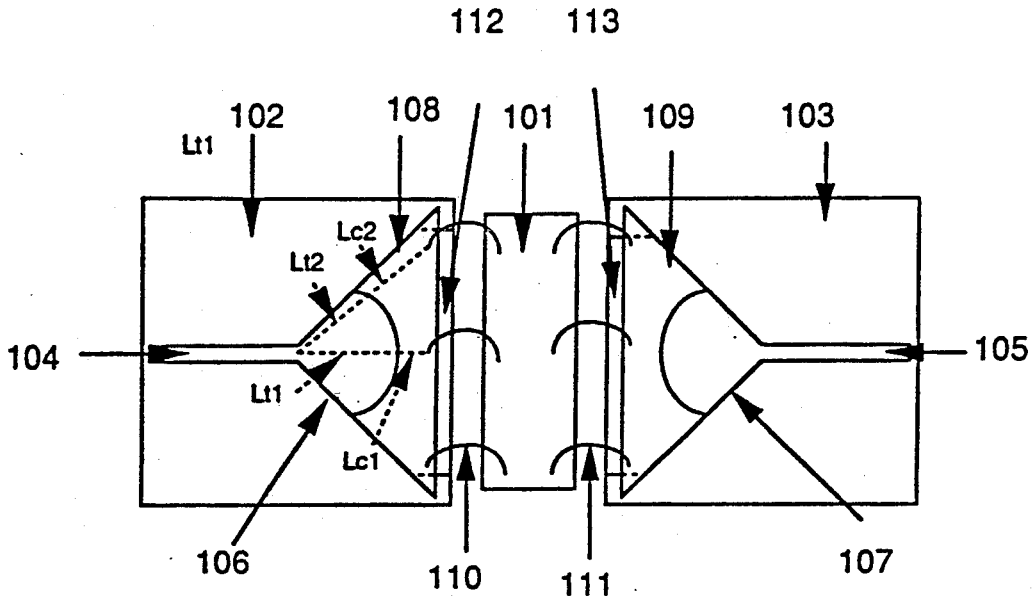
FIG. 1 is a top view showing a first embodiment of the invention.

Referring now to the drawings, some of the embodiments of the matching circuit for a high-frequency transistor of the invention are described in detail below.

Embodiment 1

Figure 7:
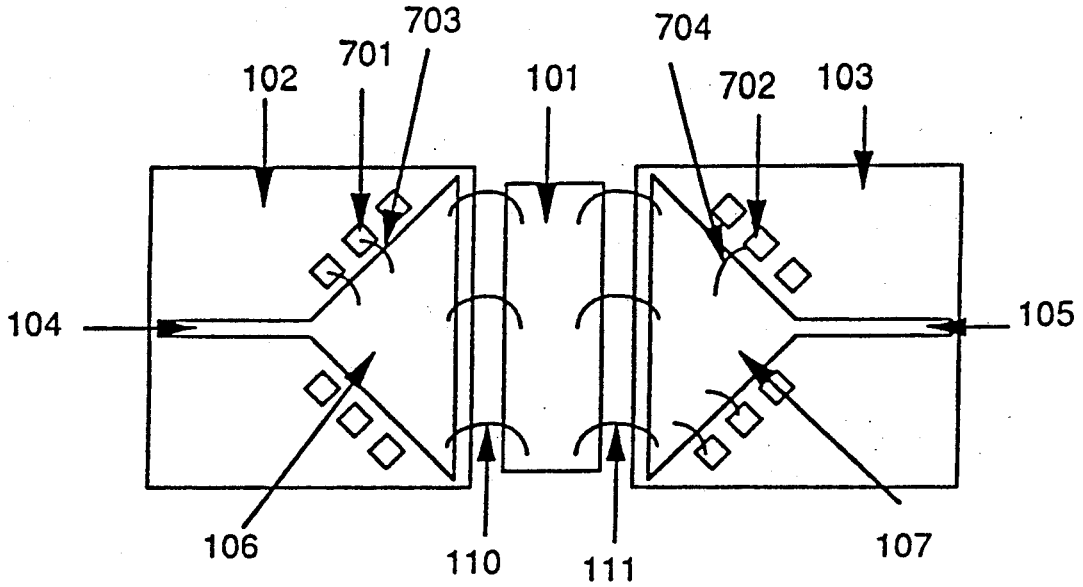
Fig.7 (PRIOR ART)
FIG. 7 and FIG. 8 are top views of conventional matching circuits.
Figure 8:
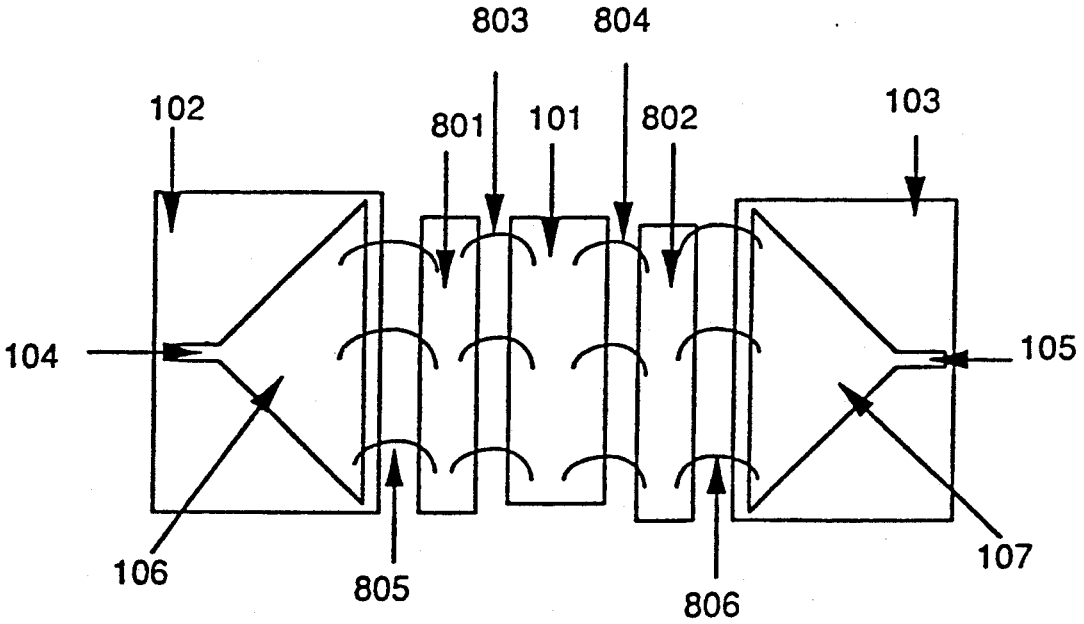
Fig.8 (PRIOR ART)

FIG. 1 is a top view of a structure of a first embodiment of the matching circuit for a high-frequency transistor of the invention. In FIG. 1, numerals 101 to 107, and 110 and 111 denote the same parts as in FIG. 7. Namely, numeral 101 denotes a field effect transistor (FET), 102 denotes an input matching circuit substrate, 103 denotes an output matching circuit substrate, 104 is a main line composed of a microstrip line connected to an input terminal, 105 is a main line composed of a microstrip line connected to an output terminal, and 106 and 107 denote taper parts each disposed at the transistor side of the main line. Numeral 110 and 111 denote wires for connecting the taper parts and the transistor 101.

Numeral 108 denotes a thin-film capacitor for input matching composing a portion of the taper part 106 by one of its electrodes, 109 denotes a thin-film capacitor for output matching composing a part of the taper part 107 by one of its electrodes, and 112 and 113 denote grounding terminals connected to the other electrodes of the thin-film capacitors 108 and 109, and are each connected to an electrode on the rear surface of the substrate through the substrate side surface.

Figure 2:
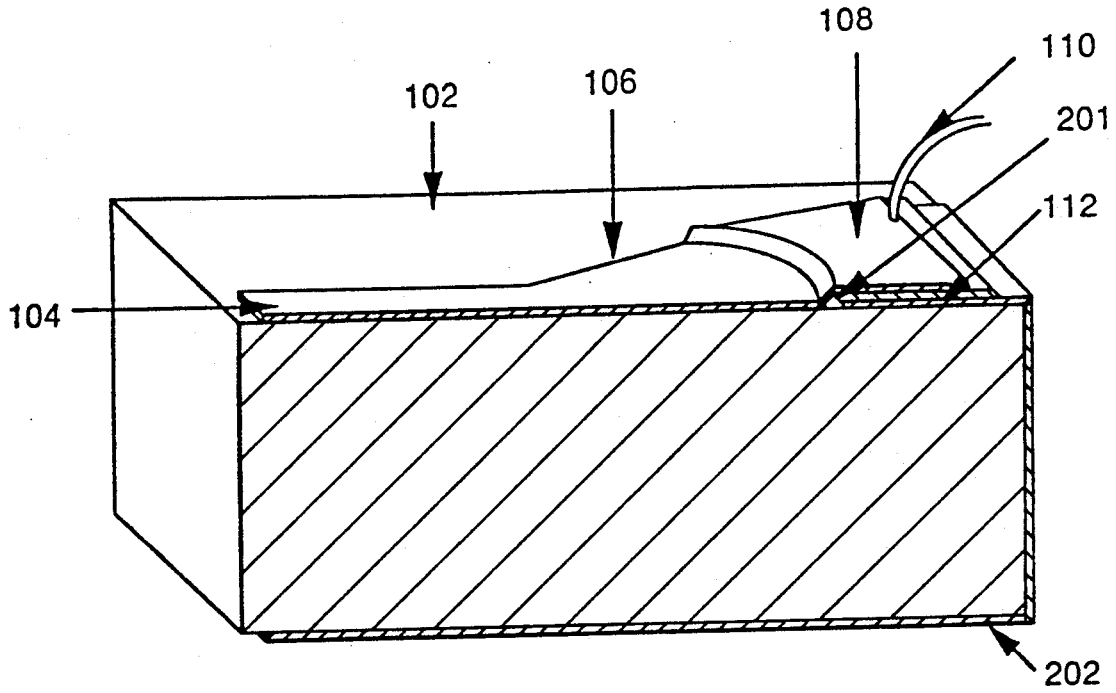
FIG. 2 is a sectional view of the first embodiment.

FIG. 2 shows its sectional structure, in which the reference numbers of parts are the same as in FIG. 1. Numeral 201 denotes a dielectric thin film which is a principal constituent part of the thin-film capacitor 108, and 202 denotes the ground side electrode on the rear surface of the substrate. As is evident from this drawing, the thin-film capacitor 108 has the electrode forming the taper part as one of its electrodes, and is opposite to the grounding terminal 112 connected to the substrate rear surface electrode 202 through the substrate side surface, with the dielectric thin film 201 intervened therebetween.

The input, output matching circuit substrates 102 and 103 are alumina ceramic substrates, and Cr-Au is used in the conductive parts of main lines 104 and 105, microstrip lines and others. Thin-film capacitors 108 and 109 are each in a metal-dielectric-metal structure using silicon oxide with the dielectric constant of about 4 as the dielectric. The thickness of the alumina ceramic substrate is 240 microns, and the thickness of the dielectric thin film is about 1 micron. As the transistor 101, a GaAs FET is used, and the frequency to be matched is 14 GHz. When the dielectric constant of the alumina substrate is 9.8, the length of the microstrip line corresponding to ¼ wavelength at 14 GHz is about 2 mm.

In this structure, the impedance matching of the input and output is effected by setting the electrostatic capacitance of the thin-film capacitors 108 and 109 to a proper value.

The matching method in this system is described in further detail below. As described above, the input, output impedances of the high power FET are several ohms to one ohm or less, considerably lower than 50 ohms of the impedance of the main line. Accordingly, in this embodiment, in order to match the impedance, the thin-film capacitor is inserted between the main line microstrip line and the ground. The wiring portion from the end of the thin-film capacitor to the ground can be regarded as a kind of microstrip line, referred to herein as an "equivalent microstrip line". Supposing the length and characteristic impedance of the equivalent microstrip line to be L and Zo, respectively, the series circuit of the thin-film capacitor and the equivalent microstrip line is expressed as follows:

$$Zin = 1/j\omega C + jZo \cdot \tan \beta L \quad (2)$$

$$= j(1/\omega C - Zo \cdot \tan \beta L) \quad (3)$$

where $\omega = 2\pi f$ $\beta = 2\pi/\lambda$ f: frequency to be matched

C: electrostatic capacitance of the thin-film capacitor

λ: wavelength in the substrate of the frequency to be matched

Since the effect of the microstrip line up to the ground appears as a tangent function, if $\beta L = \pi/2$, that is, L is sufficiently small as compared with the ¼ wavelength, its effect is small. In this case, accordingly, if the lengths from different parts of the thin-film capacitor to the grounding point are somewhat different from each other, the difference may be almost ignored. Therefore, by substantially selecting the electrostatic capacitance C at a proper value, the value of Zin can be easily controlled to be several ohms or one ohm or less.

The operation of the spatial phase difference compensation of this embodiment is described below. The in-phase electric signal wave travelling to the front end (narrower end) of the taper part 106 further propagates the taper part while spreading along the taper contour of the taper part 106 to reach the thin-film capacitor 108. Usually, the distance is longer in the part close to the side line of the taper part than in the central part, and in the case of the first embodiment, also, it is set so that the distance may be longer at the part close to the side line of the taper part to reach the thin-film capacitor. The electric signal entering the thin-film capacitor is varied in the phase velocity because the dielectric constant of the thin-film capacitor is different from that of the substrate. Since the phase velocity is inversely proportional to the square root of the dielectric constant, the phase velocity is faster when the dielectric constant is smaller. For example, if the substrate on which the microstrip line is formed is an alumina substrate, its dielectric constant is 9.8, and if the dielectric constant of silicon oxide, a dielectric for forming the thin-film capacitor, is 4, the phase velocity in the thin-film capacitor is faster than the phase velocity in the taper part by $\sqrt{9.8/4} \doteq 1.57$ times. Therefore, by properly setting the length of the thin-film capacitor of the side end part longer than the length of the thin-film capacitor in the central part, the phase delay at the side end part generated until reaching the thin-film capacitor can be restored. When the length of the main line microstrip line from the thin-film capacitor to the transistor is made equal to the length of the connecting wire, the phase difference of the electric signals can be compensated at the input part of the transistor. At this time, by setting the electrostatic capacitance of the thin-film capacitor at a value suited to the impedance matching, the impedance matching can be achieved at the same time.

The relation between the lengths of the taper part and the thin-film capacitor and the phases of the electromagnetic waves at the portion passing these parts is described in further detail below As shown in FIG. 1, supposing the linear distance from the taper part branching point to the thin-film capacitor in the central part and side end part to be respectively Lt1, Lt2, the lengths therefrom up to the output part of the thin-film capacitor in the respective travelling directions to be respectively Lc1, Lc2, the phase velocity in the taper part to be Vt and the phase velocity in the thin-film capacitor to be Vc, the condition that the phases of the electromagnetic waves branched off from the taper part branching point to be identical to each other is the same as the condition that the time required for the electromagnetic wave to reach from the taper part branching point up to the thin-film capacitor output part is identical at all parts. This relation is expressed as follows:

$$\frac{Lt1}{Vt} + \frac{Lc1}{Vc} = \frac{Lt2}{Vt} + \frac{Lc2}{Vc} \quad (4)$$

Suppose the phase velocity in the thin-film capacitor is a times the velocity in the taper part, then it follows that:

$$Vc = a\,Vt, \quad (5)$$

and this relation is applied to equation (4) which is modified as:

$$a\,Lt1 + Lc1 = a\,Lt2 + Lc2. \quad (6)$$

Hence there exists a solution to satisfy this equation even considering that the shape of the taper part is usually in the condition of $Lt1 + Lc1 < Lt2 + Lc2$.

For example, supposing a=1.57, it is sufficient to set as follows (the unit is arbitrary):

Lt1=1

Lc1=0

Lt2=0.5

Lc2=0.785.

If it is not desired to make Lc1=0, Lc1 and Lc2 may be increased by the same amount, for example, Lt1=1

Lc1=0+0.2

Lt2=0.5

Lc2=0.785+0.2.

These figures are only few examples, and various other designs are possible.

In the case of the output circuit, the process is the reverse relative to that of the input circuit, but it is consequently evident that the phase difference of electric signals caused between the side end part and the central part of the taper part end portion in the absence of the thin-film capacitor can be compensated by using the thin-film capacitor in the same way as in the input portion. As for the impedance matching, also, it is possible to match in the same way as in the input circuit.

The performance was compared between the case of employing the structure of this embodiment and the case of employing the structure of the second prior art, by using the GaAs FET of the same performance with the gate width of about 4 mm and output of about 3 watts. The power conversion efficiency was 15% and linear gain was 4 dB at 15 GHz in the method of the prior art, while the power conversion efficiency was 25% and the linear gain was 5 dB in the structure of this embodiment, and the electric characteristics were markedly enhanced.

Embodiment 2

Figure 3:
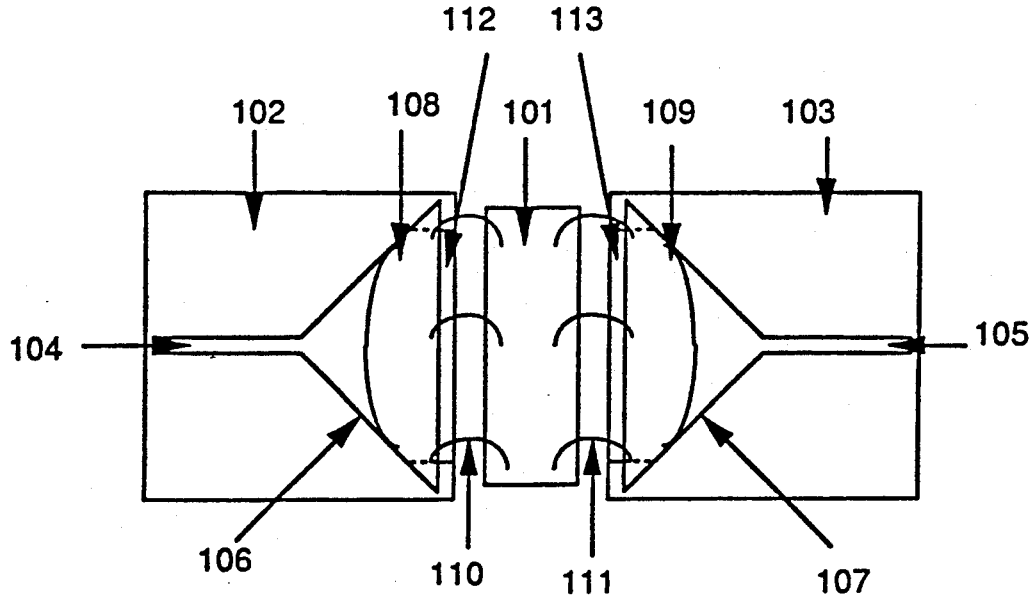
FIG. 3 is a top view showing a second embodiment of the invention.

A second embodiment of the invention is shown in FIG. 3.

In FIG. 3, the reference numbers and corresponding constituents are the same as in FIG. 1. As each of the thin-film capacitors 108 and 109, however, a thin-film capacitor in a metal-dielectric-metal structure using titanium oxide with a dielectric constant of about 90 is employed as the dielectric. The transistor and matching frequency are the same as in the first embodiment.

The difference from the first embodiment lies in the dielectric constant of the thin-film capacitor and the shape and dimensions of the thin-film capacitor. In this case, the dielectric constant of the thin-film capacitor is greater than that of the substrate, and hence the phase velocity in the thin-film capacitor part i slower than that in the taper part, or $\sqrt{9.8/90}=0.33$ times. In this case, therefore, contrary to the case of the first embodiment, it is designed so that the length of the thin-film capacitor is shorter in the portion closer to the side end of the taper part, than in the central part, so that the phase of the electric signals at the parts out of the thin-film capacitor can be equalized anywhere.

Thus, in the first and second embodiments, the effects of the grounding circuit of the thin-film capacitors can be almost ignored, or the effects are exactly the same at all parts of the taper. In such conditions, the impedance matching and spatial phase difference compensation are realized by the thin-film capacitors. The thin-film capacitor can be manufactured by thin film forming technology, such as chemical vapor-phase deposition and sputtering, and it is easy to fabricate by integrating together on various substrates such as alumina substrates. Therefore, unlike the prior art, the chip capacitor is not needed, and the number of mounting processes is small, so that it is possible to realize a reduction in size and high degree of integration, and hence the manufacturing cost can be lowered.

Embodiment 3

Figure 5:
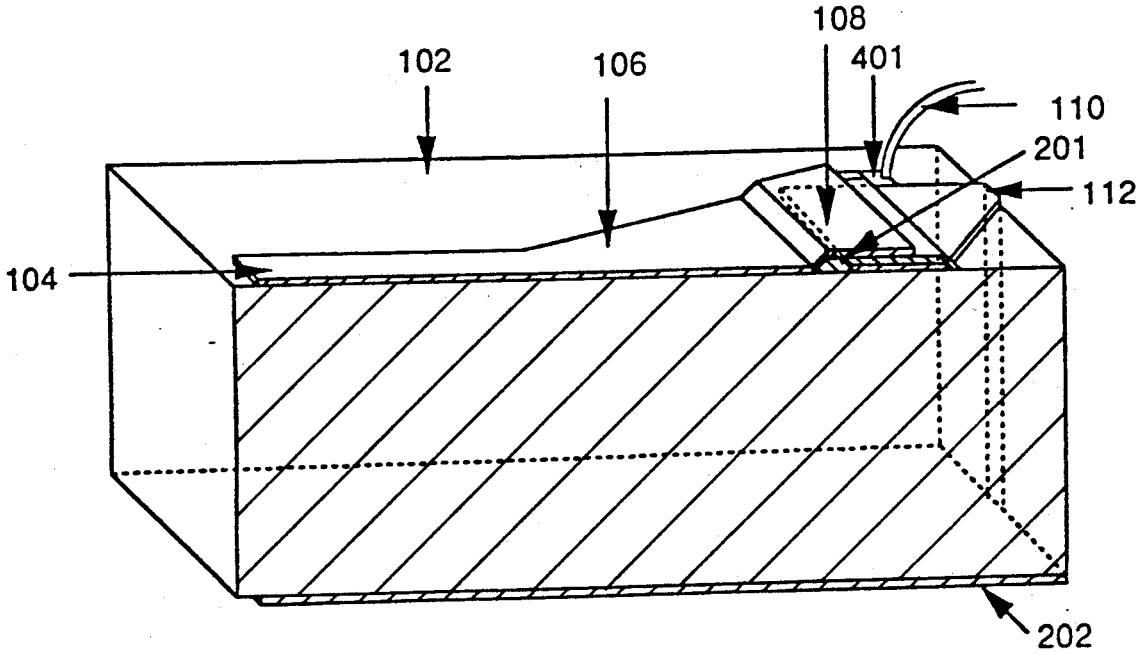
FIG. 5 is a sectional view of the third embodiment.
Figure 4:
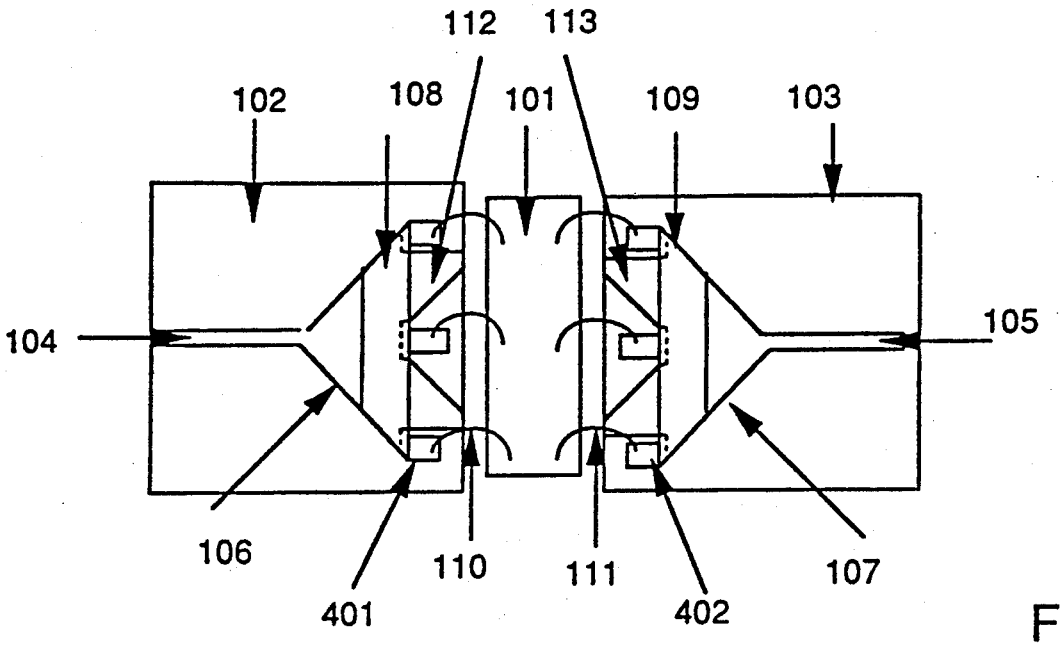
FIG. 4 is a top view showing a third embodiment of the invention.

FIG. 4 shows a third embodiment of the invention. In FIG. 4, numerals 101 to 113 denote the same constituents as in the embodiment shown in FIG. 1. In this case, since the structure of each of the thin-film capacitor grounding circuits 112 and 113 is different from that in the first embodiment, wire connection terminals 401 and 402 are disposed in this embodiment. The terminals 401 and 402 are electrically connected with the upper electrodes of the thin-film capacitors, and are electrically isolated from the grounding circuit. The grounding circuit is set so that the length up to the substrate rear side electrode 202 may be closer to the ¼ wavelength in the central part of the taper, and shorter toward the side end part. FIG. 5 shows the sectional structure of this embodiment, in which the part numbers and names are the same as in FIGS. 1 and 2.

The input, output matching circuit substrates are alumina ceramic substrates, and Cr-Au is used in the conductive parts in the main lines, microstrip lines and others. The thin-film capacitors are each of a metal-dielectric-metal structure using silicon oxide with the dielectric constant of about 4 as the dielectric. The transistor and matching frequency are the same as in the first embodiment.

The matching method of this system is described in further detail below. In this embodiment, in order to match the impedance, a series circuit of a thin-film capacitor and a closed microstrip line is inserted between the main line microstrip line and the ground. In the first and second embodiments, the grounding circuit may be substantially ignored, or the conditions are nearly equal in all parts of the taper, but in this embodiment, the microstrip line used in the grounding circuit is used for a positive purpose.

Supposing as described above that the length of the microstrip line to the ground is L, the impedance Zin of the series circuit is expressed by equation (2). Therefore, the value of Zin can be easily made within several ohms to one ohm or less, by properly selecting the length of the microstrip line up to the ground and the electrostatic capacitance of the thin-film capacitor.

The operation of the spatial phase difference compensation of this embodiment is explained below. The in-phase electric signal travelling up to the taper branching portion in phase is propagated as being expanded along the taper at the taper part to reach the thin-film capacitor part. Usually, the distance is longer at the side end part of the taper than in the central part, and in this embodiment, also, the side end part is longer. The electric signal entering the thin-film capacitor is changed in the phase velocity in the thin film capacitor part. The phase velocity is inversely proportional to the square root of the dielectric constant if the counterelectrode of the thin-film capacitor is at a complete grounding potential. Therefore, the phase velocity in the thin-film capacitor part is faster than the phase velocity in the taper part by $\sqrt{9.8/4}=1.57$ times. However, as shown in this embodiment, if the counter-electrode is not at a complete grounding potential, forming a part of the closed microstrip line, and its length is closer to ¼ wavelength, the phase velocity depends on the length of this closed microstrip line. For example, if the length is ¼ wavelength, such portion is almost open, and the phase velocity in this case is nearly the phase velocity of the alumina substrate. In other words, in this case, this is a compound dielectric having a conductor of equivalent potential between the silicon oxide film and alumina substrate, and the phase velocity is the value when there is a conductor at a grounding potential beneath the alumina substrate. In this embodiment, since the thickness of the silicon oxide film is about 1 micron and the thickness of the alumina substrate is about 240 microns, the phase velocity at this time is nearly the phase velocity in the alumina substrate. Accordingly, as in this embodiment, when the length of the microstrip line from the thin-film capacitor in the central part of the taper part to the ground is about ¼ wavelength, and is shorter in the side end part than the distance to the ground, the phase velocity is closer to that in the silicon oxide in the side end part, and is closer to that on the alumina substrate in the central part. Hence the phase velocity can be set faster in the side end part so that the phase delay in the taper part can be restored. When the length of the microstrip line from the thin-film capacitor to the transistor is set equal to the length of the connecting wire, the phase difference of the electric signals can be compensated at the input part of the transistor. At this time, by setting the electrostatic capacitance of the thin-film capacitor to a value suited to impedance matching, the impedance matching can be achieved at the same time. Meanwhile, the length of the closed microstrip line up to the ground corresponds to the completely shorted state when equal to 0, and to the completely open state when equal to the length of ¼ wavelength, and hence the effect of the embodiment may be attained by properly selecting the length below the ¼ wavelength.

In the case of the output circuit, the procedure is the reverse relative to the case of the input circuit. It is substantially evident that the phase difference of the electric signals caused in the taper part in the absence of thin-film capacitor and closed microstrip line can be similarly compensated. Impedance matching can be considered exactly the same as in the input circuit.

Using the GaAs FETs of similar performance with the gate width of about 4 mm and output of about 3 watts, the performance was compared between the case of employing the structure of this embodiment and the case of employing the structure of the second prior art. As a result, in the conventional method, at 14 GHz, the electric power conversion efficiency was 15% and the linear gain was 4 dB, while in this embodiment the power conversion efficiency was 20% and the linear gain was 4.7 dB, and the electric characteristics were markedly enhanced.

Embodiment 4

Figure 6:
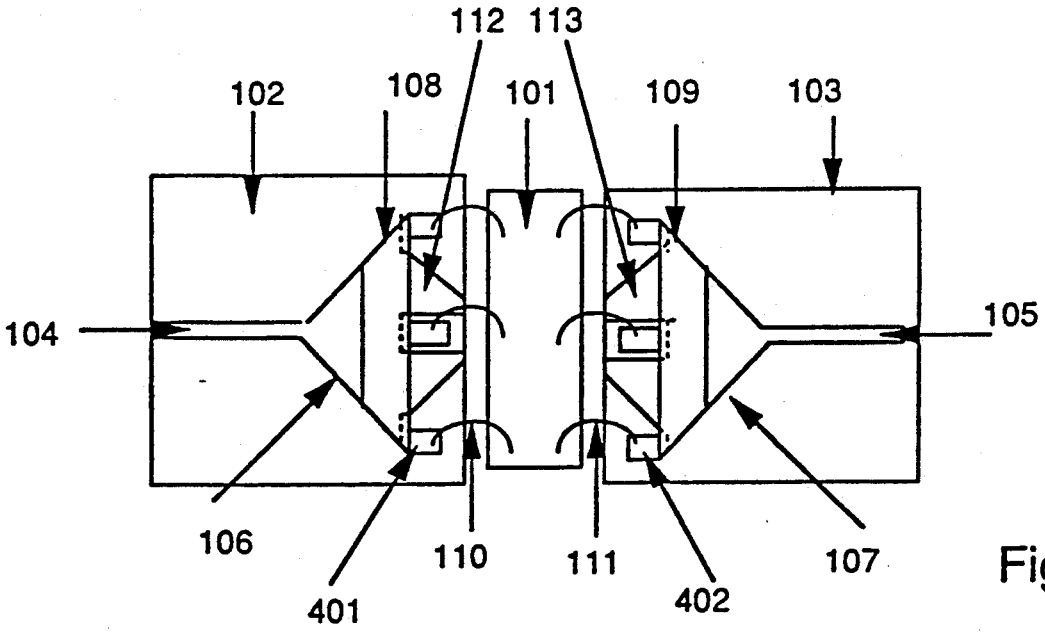
FIG. 6 is a top view of a fourth embodiment of the invention.

A fourth embodiment is shown in FIG. 6.

In FIG. 6, the part numbers and names are the same as those shown in FIG. 4.

Unlike the third embodiment, the fourth embodiment employs titanium oxide having a large dielectric constant of 90, in the same way as in the case of the second embodiment, as the dielectric of the thin-film capacitor, and also the shape and dimensions of the closed microstrip line are different. In this case, the dielectric constant of the thin-film capacitor is greater than that of the substrate, and hence the phase velocity in the thin-film capacitor part is slower, or $\sqrt{9.8/90}=0.33$ times that of the taper part. In this case, therefore, contrary to the case of the third embodiment, the length of the closed microstrip line is longer in the part closer to the side end of the taper part than in the central part, being closer to ¼ wavelength. In such a structure, the phases of the electric signals in the positions just leaving the thin-film capacitor can be the same in all parts.

What is claimed is:

1. A matching circuit for a high-frequency transistor, comprising:

a microstrip line formed on a substrate, a tapered line coupled to the microstrip line and tapering outwardly from the microstrip line for connection to the high-frequency transistor, and a thin-film capacitor portion made of a dielectric having a different dielectric constant than that of the substrate, the dielectric being disposed between the tapered line and a ground, wherein a length of the thin-film capacitor portion in a traveling direction of a high-frequency signal is continuously different in the tapered line so that a phase difference of the high-frequency signal is compensated at an output position of the thin-film capacitor portion.

2. A matching circuit according to claim 1, wherein a dielectric having a dielectric constant smaller than that of the substrate is used as a dielectric of the thin-film capacitor portion, and the length of the thin-film capacitor in the travelling direction of the high-frequency signal is shorter when approaching a central part of the tapered line.

3. A matching circuit according to claim 1, wherein a dielectric having a dielectric constant larger than that of the substrate is used as a dielectric of the thin-film capacitor portion, and the length of the thin-film capacitor in the traveling direction of the high frequency signal is longer when approaching a central part of the tapered line.

4. A matching circuit according to claim 1, wherein said thin-film capacitor portion includes an electrode formed by a portion of said tapered line, and an opposite electrode connected to the ground.

5. A matching circuit for a high-frequency transistor, comprising:

a microstrip line formed on a substrate, a tapered line coupled to the microstrip line and tapering outwardly from the microstrip line for connection to the high-frequency transistor, and a series circuit of a thin-film capacitor and a closed microstrip line disposed between the tapered line and a ground, wherein a length of the closed microstrip line to the ground is different at different parts of the thin-film capacitor so that a phase different of a high-frequency signal is compensated at an output position of the thin-film capacitor.

6. A matching circuit according to claim 5, wherein a dielectric having a dielectric constant larger than that of the substrate is used as a dielectric of the thin-film capacitor, and a maximum length of the closed microstrip line to the ground is ¼ wavelength or shorter and becomes shorter when approaching a central part of the thin-film capacitor.

7. A matching circuit according to claim 5, wherein a dielectric having a dielectric constant smaller than that of the substrate is used as a dielectric of the thin-film capacitor, and a maximum length of the closed microstrip line to the ground is ¼ wavelength or shorter and becomes longer when approaching a central part of the thin-film capacitor.

8. A matching circuit according to claim 5, wherein said thin-film capacitor includes an electrode formed by a portion of said tapered line, and an opposite electrode connected to the ground through said closed microstrip line.

* * * * *